United States Patent [19]

Hippely et al.

[11] Patent Number: 5,022,884

[45] Date of Patent: Jun. 11, 1991

[54] TEMPERATURE ACTIVATED TOY VEHICLE

[75] Inventors: Keith A. Hippely, Manhattan Beach; Eric C. Ostendorff, Torrance, both of Calif.

[73] Assignee: Mattel, Inc., Hawthorne, Calif.

[21] Appl. No.: 506,634

[22] Filed: Apr. 9, 1990

[51] Int. Cl.[5] ..... A63H 17/26

[52] U.S. Cl. ..... 446/14; 446/470

[58] Field of Search ..... 446/14, 470, 465, 466, 446/431, 464, 486, 210, 198, 435; 374/205, 206, 207; 40/442, 411, 421

[56] References Cited

U.S. PATENT DOCUMENTS

| | | | |
|---|---|---|---|
| 1,676,296 | 7/1928 | Spencer | 446/14 |
| 2,073,062 | 3/1937 | Henninger, Jr. | 40/442 |
| 2,675,543 | 4/1954 | Marchment | 40/421 |
| 4,244,140 | 1/1981 | Kim | 446/14 |
| 4,467,556 | 8/1984 | Iwao et al. | 446/470 X |
| 4,516,952 | 5/1985 | Brand et al. | 446/466 X |
| 4,693,693 | 9/1987 | Kennedy et al. | 446/470 X |
| 4,762,511 | 8/1988 | Lee | 446/470 X |

*Primary Examiner*—Mickey Yu

*Attorney, Agent, or Firm*—Roy A. Ekstrand

[57] ABSTRACT

A temperature activated toy vehicle includes a vehicle body within which a temperature responsive spring is supported. One or more vehicle body parts are movably supported within the vehicle body and are movable between alternate positions to provide alternate configurations of the vehicle. The temperature responsive spring is coupled to the movable body portions to provide alternative configurations of the toy vehicle in response to spring temperature.

11 Claims, 3 Drawing Sheets

TEMPERATURE ACTIVATED TOY VEHICLE

FIELD OF THE INVENTION

This invention relates generally to toy vehicles and particularly to those which undergo configuration or shape changes.

BACKGROUND OF THE INVENTION

One of the more entertaining and pervasive types of toys manufactured and sold through the years have been those which replicate a variety of vehicles. Common types of toy vehicles used by children for many years have included airplanes, boats, automobiles, trucks, and trains and the like. As toy designers have worked toward increasing the play value and entertainment value of such toy vehicles, various toy vehicle types have been developed which undergo shape or configuration changes.

U.S. Pat. No. 4,467,556 issued to Iwao, et al. sets forth a TOY VEHICLE CAPABLE OF CHANGING SIZE AND SHAPE in which a compound vehicle chassis includes first and second chassis members. The chassis members are movable with respect to one another and are interconnected such that they can be moved between a first and second position. The vehicle further includes a movable member associated with one of the chassis members and various interlocking body panels supported upon the chassis permit a vehicle such as a van or the like to be reconfigured by body panel and chassis motion to assume the shape corresponding to a helicopter.

U.S. Pat. No. 4,693,693 issued to Kennedy, et al. sets forth a TOY CRASH VEHICLE in which a motorized toy car is provided with a chassis upon which a hollow body is mounted. The front portion of the body includes a simulated bumper and hinged side door. A movable sled slidably supported upon the chassis is secured to the vehicle front portion. The vehicle front portion is made of a deformable material and is secured to the sled such that motion of the sled with respect to the chassis causes the vehicle front end to assume alternative shapes or configurations. In its preferred form, one shape corresponds to the normal vehicle configuration while the other conforms to a caved in or crashed front portion. A spring is coupled to the sled whereby the vehicle may be restored to a normal configuration upon releasing the sled.

U.S. Pat. No. 4,762,511 issued to Lee, et al. sets forth a TOY CRASH VEHICLE WITH SKEWABLE FRONT WHEELS in which a toy vehicle includes a hollow body mounted upon a chassis and having a front portion formed of a resilient material and freely movable with respect to the chassis. The front wheels are supported upon short axles pivotally secured to the chassis which, in their normal state, are parallelly arranged. In the crashed state, the resilient front end portion of the vehicle is caved inwardly or crashed in and the front axles pivot to assume a non-parallel relationship skewing the front wheels.

U.S. Pat. No. 1,676,296 issued to Spencer sets forth a FIGURE TOY in which a toy figure is supported upon a generally circular curved bimetallic disk. The bimetallic disk changes from a convex to concave curvature under the influence of temperature changes which in turn provides a jumping action for the toy.

U.S. Pat. No. 4,244,140 issued to Kim sets forth TOYS WITH SHAPE MEMORY ALLOYS in which a variety of toys are formed of shape memory alloys such as nitinol such that the toys may be readily deformed and thereafter heated causing them to return to their original shape.

While the foregoing described prior art toys have provided increased amusement and entertainment value, there remains a neverending need in the art for further improvements, modifications and changes to toy vehicles which further improve and increase the entertainment values thereof.

SUMMARY OF THE INVENTION

Accordingly, it is a general object of the present invention to provide an improved toy vehicle. It is a more particular object of the present invention to provide an improved toy vehicle which undergoes predetermined shape changes. It is a still further object of the present invention to provide an improved toy vehicle having a changeable shape which changes in response to temperature changes only and does not need to be manually triggered.

In accordance with the present invention, there is provided a temperature activated toy vehicle comprises: a vehicle body; a vehicle component movably supported by the vehicle body and movable with respect thereto between first and second positions; and temperature responsive activating means, coupled to the vehicle body and the vehicle component, for moving the vehicle component between the first and second positions.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
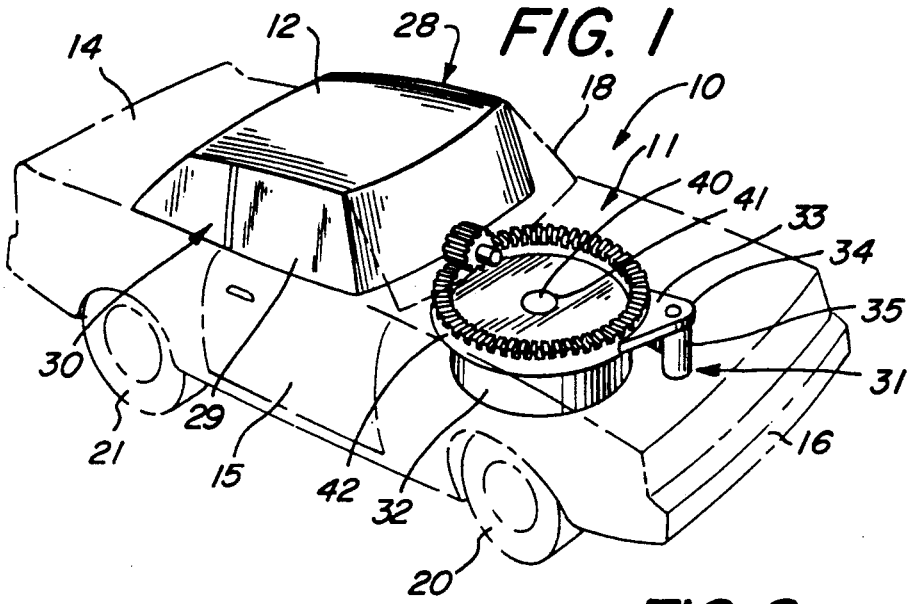
FIG. 1 sets forth a perspective view of a temperature activated toy vehicle constructed in accordance with the present invention.

FIG. 1 sets forth a perspective view of a temperature activated toy vehicle constructed in accordance with the present invention and generally referenced by numeral 10. Vehicle 10 includes an outer body 11 which is shown in dashed line representation to facilitate the clear depiction of the relevant moving parts associated with the present invention temperature activated feature. Body 11 is configured to replicate a more or less conventional automobile having a quartet of wheels 20, 21, 22 and 23 (wheels 22 and 23 not seen in FIG. 1). Body 11 further includes door 15, a front windshield 18, a trunk 14, a hood 19 and a front bumper 16, all assembled in accordance with conventional fabrication techniques. In accordance with an important aspect of the present invention, toy vehicle 10 further includes a rotatable cockpit member 30 which includes a roof portion 12, a rear windshield 17 (seen in FIG. 3) as well as conventional side windows. In further accordance with an important aspect of the present invention, rotatable cockpit member 30 is separate from body 11 and includes a forwardly extending pin 44 and a rearwardly extending pin 45 (seen in FIGS. 2 and 3). Pin 44 further includes a driven gear 43 which is secured to rotatable cockpit member 30. In accordance with the present invention and as set forth below in greater detail, rotatable cockpit member 30 is supported entirely by pins 44 and 45 and driven gear 43 with respect to body 11.

Figure 3:
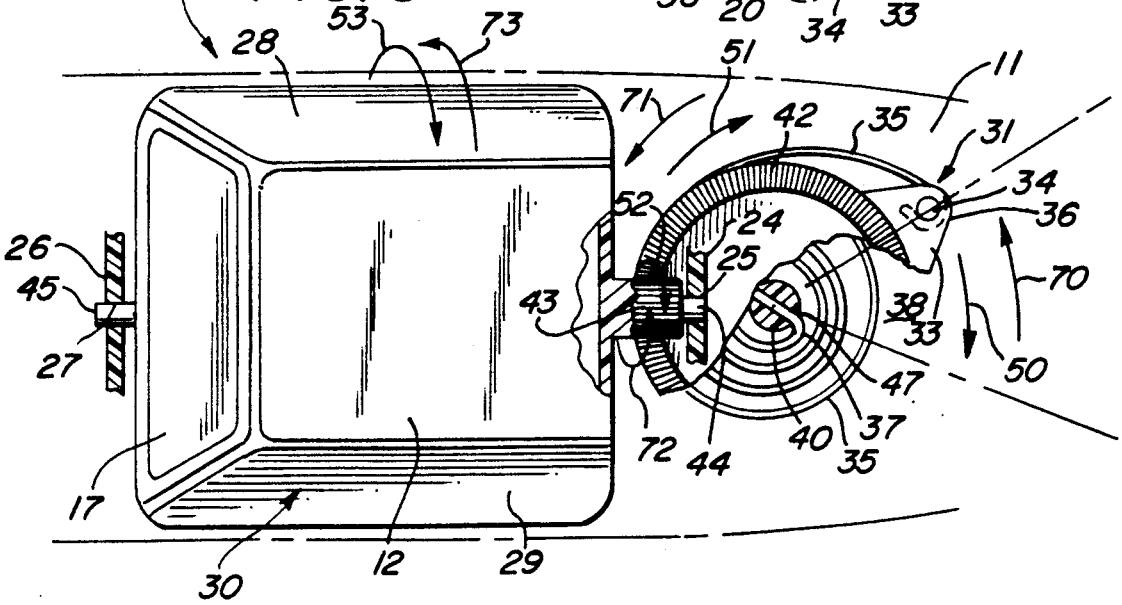
FIG. 3 sets forth a partially sectioned top view of a temperature activated toy vehicle constructed in accordance with the present invention.

A spring drive unit 30 includes a generally cylindrical spring cup 32 having a downwardly facing opening and defining an internal cavity 38 (seen in FIG. 3). Spring cup 32 further defines a center aperture 41 and an annular upwardly facing ring gear 42. Body 11 defines an upwardly extending generally cylindrical center post 40 which extends through spring cup 32 and is received within aperture 41 to rotatably secure spring cup 32 with respect to body 11. Spring cup 32 further defines an outwardly extending tab 33 having a pin 34 extending downwardly therefrom. An elongated coiled bimetallic spring 35 is coiled within spring cup 32 about center post 40 and extends outwardly beneath tab 33 to embrace pin 34. Spring 35 is shown more clearly in FIG. 3. However, suffice it to note here that spring 35 comprises a bimetallic temperature sensitive spring which tends to coil more tightly as it is cooled and tends to uncoil or coil more loosely as it is heated or vice versa depending on its construction. For this discussion, we will assume coiling tightly when cooled and looser when warmed.

In the position shown in FIG. 1, toy vehicle 10 assumes the closed position in which rotatable cockpit member 30 is positioned such that roof 12 extends upwardly above body 11. In addition in the position shown in FIG. 1, spring drive 31 and spring 35 are configured in accordance with the hot temperature condition of spring 35. Thus, tab 33 assumes the angular position shown in FIG. 1 and supports rotatable cockpit member 30 in the manner shown. In the absence of temperature changes, spring drive 31 continues to support rotatable cockpit member 30 in the closed configuration shown in FIG. 1 and toy vehicle 10 may be played with in accordance with the common play activities associated with such toy vehicles.

Figure 2:
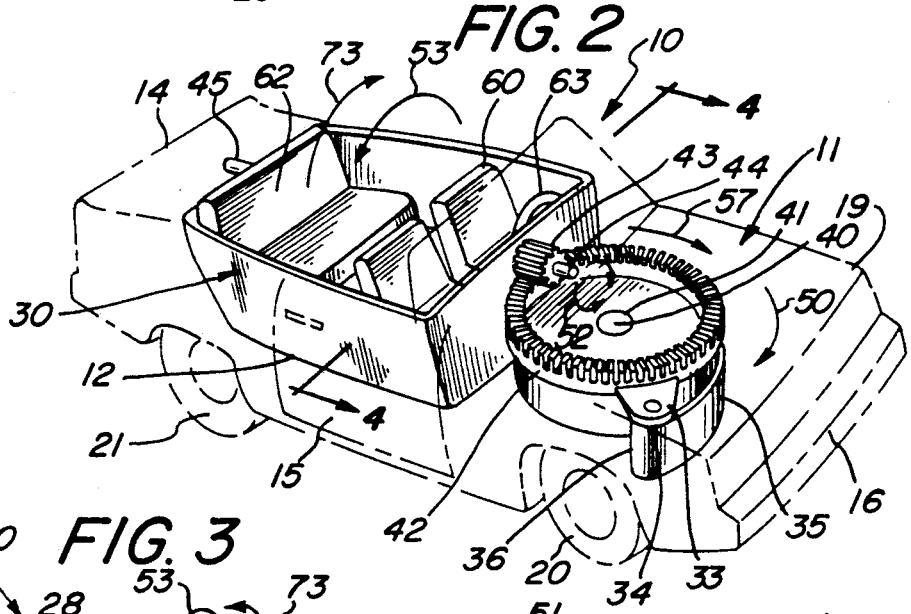
FIG. 2 sets forth a perspective view of the present invention toy vehicle embodiment of FIG. 1 in an alternate configuration.

FIG. 2 sets forth the reconfiguration of toy vehicle 10 in response to a decrease in temperature of spring drive unit 31. Thus as set forth above, toy vehicle 10 includes a generally conventional body 11 having a front bumper 16, a trunk 14, a door 15 and a hood 19 as well as a quartet of supporting wheels 20 through 23. As is also set forth above, spring drive unit 31 includes a generally cylindrical downwardly facing spring cup 32 having a center aperture 41, an outwardly extending tab 33 and an upwardly facing ring gear 42. A bimetallic spring 25 is coiled about center post 40 in body 11 and is received upon pin 34. Rotatable cockpit member 30 includes a forwardly extending pin 44 and a rearwardly extending pin 45. Cockpit member 30 further includes a driven gear 43 which is engaged with ring gear 42 in a driving relationship. As mentioned above, rotatable cockpit member 30 is rotatably supported with respect to body 11 by pins 44 and 45 and driven gear 43 (such support better seen in FIG. 3). As is also mentioned above, rotatable cockpit member 30 includes a roof portion 12 and conventional side windows.

In accordance with an important aspect of the present invention and by comparison of FIGS. 1 and 2, it will be noted that the response of toy vehicle 10 to temperature decreases from FIG. 1 to FIG. 2 results in a creation of a spring force within spring 35 causing a rotation of spring cup 32 in the direction indicated by arrow 50. The rotation of spring cup 32 in the direction of arrow 50 causes a corresponding rotation of ring gear 42 in the direction indicated by arrow 51. The rotation of ring gear 42 in turn causes a rotation of driven gear 43 in the direction indicated by arrow 52 which in turn rotates cockpit member 30 about pins 44 and 45 in the direction indicated by arrow 53. Thus, FIG. 2 sets forth the configuration of toy vehicle 10 upon the completion of the rotation of cockpit member 30 from the closed position of FIG. 1 to the fully open position of FIG. 2 which, of course, depicts a convertible having its top down. To increase the realism of toy vehicle 10, the underside of rotatable cockpit member 30 depicts the open cockpit of a convertible having a pair of front seats 60 and 61, a rear seat 62 and a steering wheel 63. Toy vehicle 10 maintains the "top down convertible" appearance of FIG. 2 so long as the temperature of spring 35 remains cool. If toy vehicle 10 is permitted to warm or subjected to a warming air or liquid flow, the above-described motion of spring cup 32 is reversed causing spring cup 32 to return to the position shown in FIG. 1 which in turn causes the rotation of cockpit member 30 back to the closed position of FIG. 1.

In accordance with an important aspect of the present invention, the configuration of toy vehicle 10 between the closed configuration of FIG. 1 and the open configuration of FIG. 2 may be repeatably performed without damaging vehicle 10. It will be apparent to those skilled in the art that any number of methods may be used to alter the temperature of vehicle 10 to produce the desired changes of vehicle configuration. For example, a conventional heating apparatus such as a hairdryer or the like may be directed at the front portion of vehicle 10 to cause heating thereof. Alternatively, vehicle 10 may be placed in a warm environment such as direct sunlight for an extended period of time and sufficient heating may be obtained to cause vehicle 10 to automatically reconfigure to the closed position. Additional realism is provided in that vehicle 10 thereafter placed in a cool environment seems to automatically lower the top and reconfigure vehicle 10 to an open or top down convertible configuration. In addition to the foregoing temperature change methods, toy vehicle 10 may be utilized with the color change feature produced on present toy vehicles such as the Convertables toy vehicles manufactured by Mattel, Inc. In such case, the color change of vehicle 10 is affected by submerging or partially submerging vehicle 10 in the desired temperature water. Color change combined with shape change is a preferred embodiment since it provides an overall effect more dramatic than shape change alone.

FIG. 3 sets forth a partially sectioned view of toy vehicle 10 in the closed position of FIG. 1. As can be seen, rotatable cockpit member 30 includes a roof portion 12, a rear windshield 17 and a pair of outwardly extending support pins 44 and 45. Support pin 44 further includes a driven gear 43 which is firmly secured to rotatable cockpit member 30. While numerous methods of fabricating rotatable cockpit member 30 may be utilized, in its preferred form, cockpit member 30 is formed of a single integral molded plastic member. Body 11 is constructed as set forth above and includes an upwardly extending center post 40 having a slot 47 extending therethrough. Body 11 further defines a pivot support 24 having an aperture 25 therein. Pin 44 of rotatable cockpit member 30 extends into and is received within aperture 25 to form the front support of cockpit member 30. Similarly, body 11 further defines a rear pivot support 26 having an aperture 27 therein which receives pin 45 of cockpit member 30 forming the rear support thereof. In its preferred form, body 11 center post 40, pivot support 24 and pivot support 26 may be fabricated using a single molded unit.

As described above, spring drive unit 31 includes a generally cylindrical cup 32 having an aperture 41 (seen in FIG. 1) which receives center post 40 to pivotally support spring drive 31. Spring cup 32 further includes an upwardly extending ring gear 42 and an outwardly extending tab 33. Tab 33 further includes a downwardly extending pin 34. A bimetallic coiled spring 35 includes a spring end 37 received within slot 47 of center post 40 and an end loop 36 which encircles and captivates pin 34. Thus, bimetallic coiled spring 35 is secured between center post 40 and pin 34 and is largely contained within cavity 38 of spring cup 32. The rigid attachment of end 37 of spring 35 to center post 40 causes the temperature changes of spring 35 to produce rotational motion of spring cup 32. Thus, as mentioned above as the temperature of spring 35 is changed, spring 35 coils more tightly or more loosely about center post 40 which in turn produces rotation of spring cup 32. FIG. 3 depicts toy vehicle 10 in the closed configuration shown in FIG. 1. Accordingly, an decrease in temperature of spring 35 causes spring 35 to coil more tightly forcing pin 34 and tab 33 to rotate about center post 40 in the direction indicated by arrow 50. The rotation of tab 33 in the direction of arrow 50 causes a corresponding rotation of ring gear 42 in the direction indicated by arrow 51 which in turn rotates driven gear 43 in the direction indicated by arrow 52. The rotation of driven gear 43 in turn causes the rotation of rotatable cockpit member 30 in the direction indicated by arrow 53. The above-described rotation continues until rotatable cockpit member 30 has completed the approximately one hundred and eighty degree rotation from the position of FIG. 1 to that of FIG. 2.

Conversely as spring 35 is heated, it coils more loosely about center post 40 causing tab 33 to rotate in the direction indicated by arrow 70 which in turn rotates ring gear 42 in the direction indicated by arrow 71. The ring gear rotation in the direction indicated by arrow 71 in turn rotates driven gear 43 in the direction indicated by arrow 72 causing cockpit member 30 to be rotated in the direction indicated by arrow 73. If the heating of spring 35 continues, cockpit member 40 is returned to the closed position shown in FIG. 1.

Figure 4:
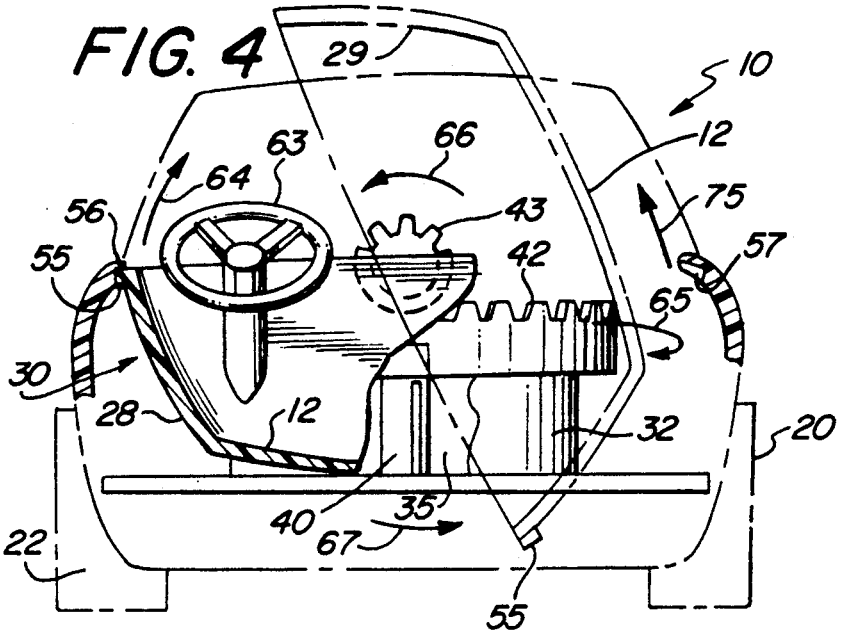
FIG. 4 sets forth a partially sectioned view of the present invention temperature activated toy vehicle taken along section lines 4—4 in FIG. 2.

FIG. 4 sets forth a section view of toy vehicle 10 taken along section lines 4—4 in FIG. 2. In addition, FIG. 4 depicts rotatable cockpit member 30 in dashed line representation at a position intermediate the positions shown in FIGS. 1 and 2. Accordingly, body 11 is supported by a pair of wheels 20 and 22. Body 11 further defines an upwardly extending center post 40 and a pair of notches 56 and 57. As described above, spring cup 32 is pivotally supported upon center post 40 of body 11 and includes an upwardly extending ring gear 42. A bimetallic spring 35 is coupled between center post 40 and spring cup 32 as described above. Rotatable cockpit member 30 includes a roof portion 12 and a pair of side windows 28 and 29. Cockpit member 30 further includes a steering wheel 63, a driven gear 43 and an outwardly extending limit tab 55. In the position shown in FIG. 4, spring 35 has been cooled and rotatable cockpit member 30 assumes the open convertible position shown in FIG. 2. Accordingly, spring 35 produces the above-described rotational force upon cockpit member 30 in the direction indicated by arrow 64. The force of spring 35 in the direction indicated by arrow 64 forces tab 55 of cockpit member 30 against notch 56 in body 11. The interference of tab 55 against notch 56 limits the angular rotation of cockpit member 30 in the direction indicated by arrow 64. Thus, further cooling of spring 35 produces additional force between tab 55 and notch 56. However, tab 55 precludes further rotation of rotatable cockpit member 30 beyond the open cockpit position shown in FIGS. 2 and 4. In accordance with the above-described operation as spring 35 is heated, a heating transition takes place causing spring 35 to be coiled more loosely about center post 40. As is also described above, the heating of spring 35 and its looser coiling about center post 40 causes spring cup 32 and ring gear 42 to rotate in the direction indicated by arrow 65. Rotation of ring gear 42 in turn rotates driven gear 43 and thereby rotatable cockpit member 30 in the direction indicated by arrow 66. As the rotation of ring gear 42 continues, cockpit member 30 is rotated to the intermediate position shown in dashed line representation in FIG. 4. Thereafter, further heating of spring 35 causes further rotation of ring gear 42 and driven gear 43 which in turn further rotates cockpit member 30 to the closed position in which roof 12 is aligned with windshield 18. As cockpit member 30 approaches the closed position shown in FIG. 1, tab 55 is received within notch 57 which precludes further rotation of cockpit member 30 in the direction of arrow 66. Thus, the cooperation of tab 55 and notch 57 provides a limit on the rotation of cockpit member 30 in the direction of arrow 66. As a result, continued heating of spring 35 produces a force in the direction indicated by arrow 75 by tab 55 against notch 57. However, further rotation is precluded.

It will be apparent in view of the foregoing to those skilled in the art that the present invention is not limited to the embodiment shown in FIGS. 1 through 4 and that numerous other temperature activated vehicle features may be constructed without departing from the spirit and scope of the present invention. Accordingly, FIGS. 5, 6, 7 and 8 set forth additional embodiments of the present invention. Such additional embodiments should, however, be considered to be exemplary and by no means form a limitation on the number of further embodiments which can be fabricated without departing from the spirit and scope of the present invention.

Figure 5:
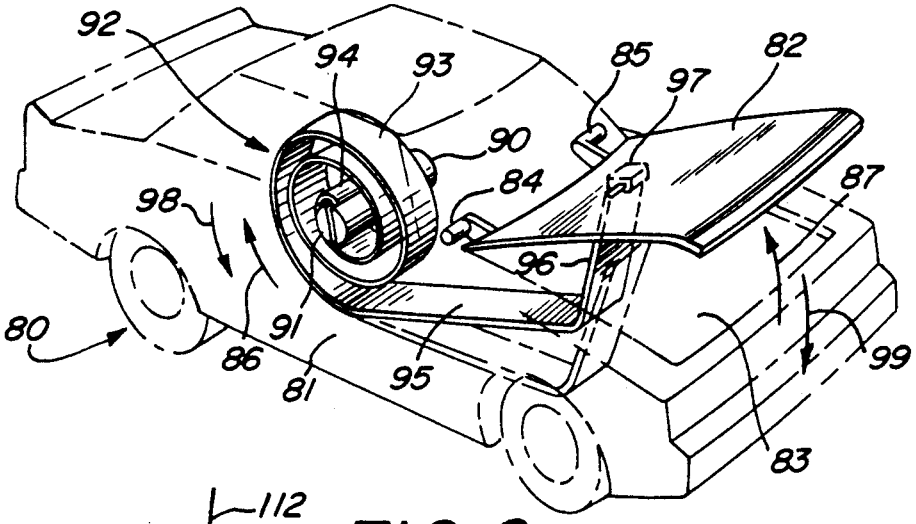
FIG. 5 sets forth a perspective view of an alternate embodiment of the present invention temperature activated toy vehicle.

Specifically with reference to FIG. 5, a temperature activated toy vehicle constructed in accordance with the present invention and generally referenced by numeral 80 includes a conventional body 81 preferably fabricated of a molded plastic material. Body 81 further defines a horizontally extending internal support post 90 having a slot 91 therein. Body 81 further includes a generally planar hood portion 82 having a pair of hinge attachments 84 and 85 which in accordance with conventional fabrication techniques are pivotally secured within body 81. Thus, hood 82 is pivotable about hinges 84 and 85. Body 81 further defines an internal engine compartment 83 beneath hood 82. A bimetallic spring 92 defines a spring coil portion 93 having an end portion 94 received within slot 91. Spring coil 93 encircles support post 90 and terminates in an outwardly extending generally straight beam portion 95 and an upwardly extending extension portion 96. A clasp 97 formed on the underside of hood 82 receives extension 96 in a conventional attachment.

In the position shown in FIG. 5, bimetallic spring 92 is cooled causing spring coil 93 to coil more tightly about support post 90 in the direction indicated by arrow 98. The rotation of coil portion 93 in the direction indicated by arrow 98 causes a corresponding angular motion of beam portion 95 and extension 96 in the direction indicated by arrow 87. The angular rotation of beam portion 95 and extension 96 of spring 92 forces hood 82 upwardly rotating it about hinges 84 and 85 to the open position shown in FIG. 5. Conversely, the heating of spring 92 causes coil portion 93 to expand about support post 90 which in turn rotates coil portion 93 in the direction indicated by arrow 86 causing beam portion 95 and extension 96 to be pivoted about post 90 in the direction indicated by arrow 99. Correspondingly, the pivotal motion of beam portion 95 and extension 96 cause hood portion 82 to be pivoted downwardly about hinges 84 and 85 in the direction indicated by arrow 99 to close engine compartment 83. Thus, the embodiment shown in FIG. 5 provides a toy vehicle in which the hood portion is raised or lowered in response to temperature changes to which the toy vehicle is subjected.

Figure 6:
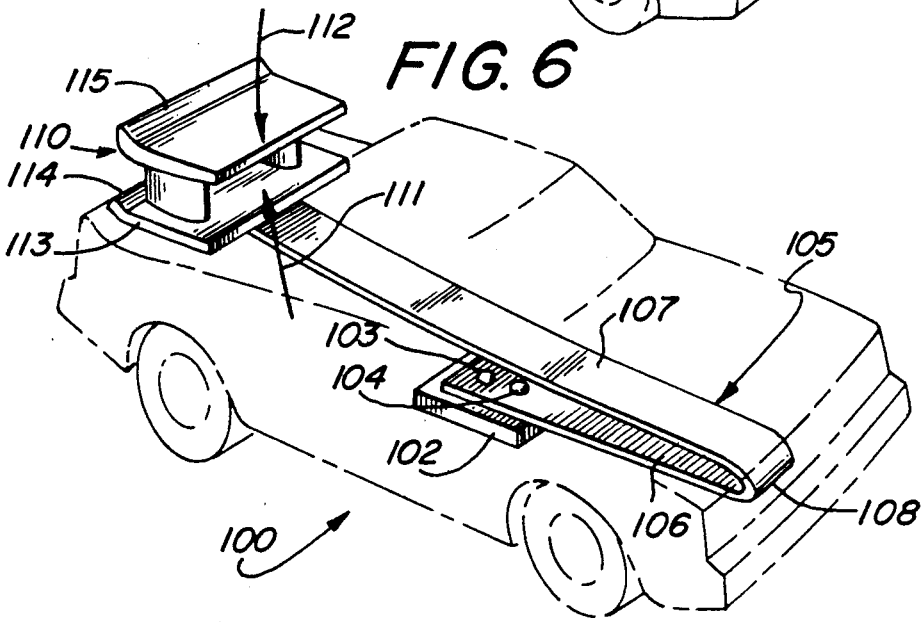
FIG. 6 sets forth a perspective view of a further alternate embodiment of the present invention toy vehicle.

FIG. 6 sets forth a still further alternate embodiment of the present invention temperature activated toy vehicle generally referenced by numeral 100. Toy vehicle 10 includes a body 101 generally constructed to replicate a conventional automobile and defining a rectangular trunk opening 113. A spoiler assembly 110 includes a base 114 configured to be received within trunk opening 113 and a spoiler foil 115 also configured to be received within trunk opening 113 and spaced above base 114. A spring base 102 formed within body 101 defines a pair of upwardly extending pins 103 and 104. A bimetallic generally U-shaped spring 105 includes a straight beam portion 106 secured to spring base 102 by pins 103 and 104, a bend portion 108, and a beam portion 107. Beam portion 107 is secured to the underside of base 114 by conventional attachment means not shown. Because spring 105 is fabricated of a bimetallic member, the angular position between straight beam portions 106 and 107 about bend portion 108 changes as the temperature of spring 105 is changed. In the position shown in FIG. 6, spring 105 is extended in response to an increased temperature thereof. The elevated temperature of spring 105 in turn causes spoiler assembly 110 to be moved upwardly in the direction indicated by arrow 111. The upward motion of spoiler assembly 110 causes base 114 to be received within trunk opening 113 and position spoiler foil 115 in the raised position. Conversely, the cooling of spring 105 causes bend portion 108 to contract which in turn causes beam portion 107 to move downwardly toward beam portion 106 which in turn lowers spoiler assembly 110 in the direction indicated by arrow 112. As spring 105 continues to be cooled, spoiler assembly 110 continues to move downwardly until spoiler foil 115 is received within trunk opening 113 and base portion 114 is enclosed within body 101 of toy vehicle 100. Thus, the embodiment shown in FIG. 6 provides a spoiler assembly which may alternatively be raised or lowered in response to temperature changes of the toy vehicle.

Figure 7:
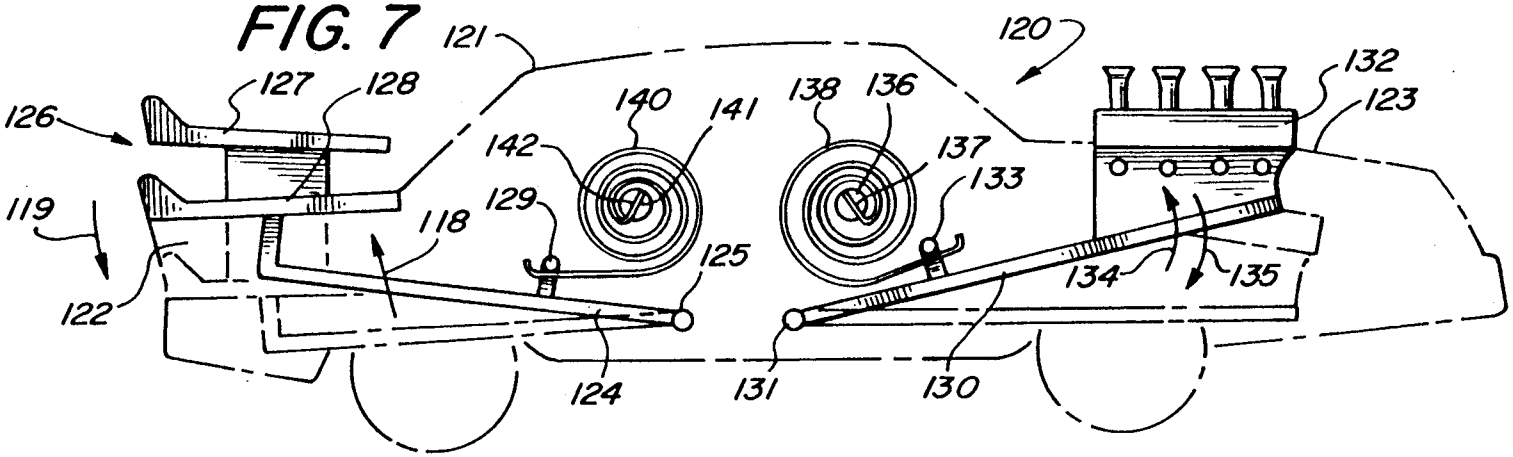
FIG. 7 sets forth a section view of a still further alternate embodiment of the present invention temperature activated toy vehicle.

FIG. 7 sets forth a still further embodiment of the present invention in which a toy vehicle 120 includes a vehicle body 121 shown in dashed line representation and having a trunk opening 122 and a hood opening 123. Body 121 further includes a pair of horizontally extending support posts 141 and 136 defining slots 142 and 137 respectively therein. A pivot arm 124 is pivotally secured to body 121 by a pivotal attachment 125 and supports a spoiler assembly 126. Spoiler assembly 126 includes a base 128 and a spoiler foil 127. Foil 127 and base 128 are configured to fit within trunk opening 122. A coil spring 140 formed of a bimetallic material is supported about post 141 and is coupled between slot 142 of post 141 and bracket 129 of pivot arm 124. A second coil spring 138 encircles post 136 and is similarly formed of a bimetallic material and extends between slot 137 and bracket 133 of pivot arm 130.

In the position shown in FIG. 7, springs 138 and 140 have been cooled and are thus more tightly wound about posts 136 and 141 respectively. The tighter coiling of springs 138 and 140 causes an upward force against brackets 133 and 129 respectively. The upward force against brackets 133 and 129 causes pivotal motion of pivot arms 130 and 124 in the directions indicated by arrows 134 and 118 respectively. The rotated positions of pivot arms 130 and 124 cause engine 132 and spoiler assembly 126 to be raised upwardly within hood opening 123 and trunk opening 122 respectively.

Conversely, as springs 138 and 140 are heated, the upward force against brackets 133 and 129 is released and pivot arms 130 and 124 pivot downwardly under the influence of gravity in the directions indicated by arrows 135 and 119 respectively. The rotation of pivot arms 130 and 124 cause engine 132 and spoiler assembly 126 respectively to be lowered into hood opening 123 and trunk 122. Thus, a vehicle shown in FIG. 7 is configured alternatively between a first configuration simulating a high performance vehicle having an enlarged upwardly extending engine and a rear spoiler to a more docile conventional automobile having a conventional trunk lid and a normal engine position. The sole factor in providing the configuration of the vehicle shown in FIG. 7 is the temperature to which the vehicle is subjected.

Figure 8:
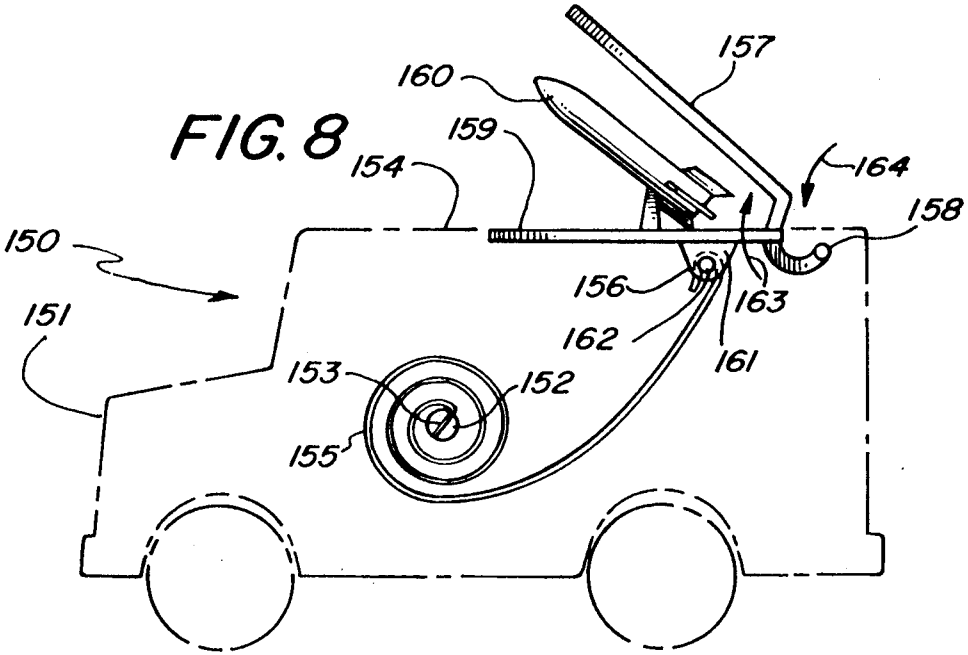
FIG. 8 sets forth a section view of a still further alternate embodiment of the present invention temperature activated toy vehicle.

FIG. 8 sets forth a still further embodiment of the present invention temperature activated toy vehicle generally referenced by numeral 150. Vehicle 150 includes a body 151 shown in dashed line representation and configured to correspond to a conventional truck or the like. Body 151 defines an upwardly extending opening 154 and a horizontally extending generally cylindrical post 152 having a transverse slot 153 therein. A trapped door 157 and a base member 159 are similarly sized and shaped and are commonly joined to a pivot 158. A simulated missile 160 is supported between trap door 157 and base member 159. Base member 159 further defines a downwardly extending tab 161 having a transverse pin 162. Thus, the combined assembly of trapped door 157, base 159 and missile 160 is pivotally movable about pivot 158. A bimetallic coiled spring 155 is coiled about post 152 and engages slot 153 at one end and terminates in a loop portion 156 encircling pin 162 at the other end.

In the position shown in FIG. 8, spring 155 is cooled causing a tight coiling thereof about post 152. Accordingly, the force coupled by spring 155 to tab 161 forces base 159 upwardly into opening 154 in the direction indicated by arrow 163. Thus with spring 155 cooled, vehicle 150 assumes a simulated missile firing position shown in FIG. 8.

Conversely, as spring 155 is warmed, a spring force is imparted by spring 155 to pin 162 and tab 161 which draws base 159 downwardly about pivot 158 in the direction indicated by arrow 164. The continued heating of spring 155 further rotates base 159, missile 160 and trapped door 157 about pivot 158 until trapped door 157 is received within opening 154. When so configured, missile 160 is entirely concealed within toy vehicle 150 giving vehicle 150 a conventional truck or van appearance.

What has been shown is an improved toy vehicle having a temperature activated feature in which a variety of vehicle configurations may be obtained as a function of vehicle temperature. While several embodiments have been shown dealing with automotive-type vehicles, it will be apparent to those skilled in the art that other vehicles such as airplanes, trains, military vehicles and ships may be similarly provided with temperature activated features without departing from the spirit and scope of the present invention. Accordingly, as used herein, the term vehicle should be understood to include and not be limited to the foregoing referenced automobiles, trucks, airplanes, trains, ships and the like.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A temperature activated toy vehicle comprising:

a vehicle body;

a vehicle component movably supported by said vehicle body and movable with respect thereto between first and second positions; and temperature responsive activating means, coupled to said vehicle body and said vehicle component, for moving said vehicle component between said first and second positions.

2. A temperature activated toy vehicle as set forth in claim 1 wherein said temperature responsive activating means include a temperature responsive spring member.

3. A temperature activated toy vehicle as set forth in claim 2 wherein said spring member is formed of a bimetallic spring.

4. A temperature activated toy vehicle as set forth in claim 3 wherein said vehicle component includes a vehicle outer body portion.

5. A temperature activated toy vehicle as set forth in claim 4 wherein said vehicle component undergoes pivotal motion.

6. A temperature activated toy vehicle as set forth in claim 5 wherein said vehicle body includes a spring support member and wherein said spring includes a coiled portion.

7. A temperature activated toy vehicle comprising:

a vehicle body having an outer body and an internal cavity;

a vehicle component movably supported by said vehicle body and movable with respect thereto between first and second positions; and temperature responsive activating means, coupled to said vehicle body and said vehicle component, for moving said vehicle component between said first and second positions.

8. A temperature activated toy vehicle as set forth in claim 7 wherein said vehicle body replicates an automobile and wherein said vehicle component includes a rotatable cockpit member having a first side replicating an automobile top and a second side replicating an open cockpit and interior of a convertible automobile.

9. A temperature activated toy vehicle as set forth in claim 8 wherein said vehicle body replicates an automobile and wherein said vehicle component includes a spoiler assembly having a first raised position and a second lowered position.

10. A temperature activated toy vehicle as set forth in claim 8 wherein said vehicle body replicates an automobile and wherein said vehicle component includes an engine replica having a first raised position and a second lowered position.

11. A temperature activated toy vehicle as set forth in claim 8 wherein said vehicle body replicates an automobile and wherein said vehicle component includes a concealable element having a first raised position and a second lowered position.

* * * * *